United States Patent [19]
Baumann et al.
[11] 4,229,172
[45] Oct. 21, 1980

[54] DISPERSE DYEING OF POLYESTER WITH BENZALKETO DERIVATIVES AS CARRIERS: BENZALACETONE, METHYL CINNAMATE ETC.

[75] Inventors: Hans-Peter Baumann, Ettingen; Hans-Georg Karmann, Binningen, both of Switzerland; Achim Wiedemann, Weil am Rhein, Fed. Rep. of Germany

[73] Assignee: Sandoz Ltd., Basel, Switzerland

[21] Appl. No.: 879,562

[22] Filed: Feb. 21, 1978

Related U.S. Application Data

[63] Continuation-in-part of Ser. No. 786,073, Apr. 11, 1977, abandoned.

[30] Foreign Application Priority Data

Apr. 15, 1976 [CH] Switzerland ..... 4849/76
Jun. 8, 1976 [CH] Switzerland ..... 7186/76

[51] Int. Cl.[2] ..... D06P 3/82; D06P 1/68
[52] U.S. Cl. ..... 8/533; 8/130.1; 8/582; 8/594
[58] Field of Search ..... 8/92, 93, 21 C, 173, 8/174, 175, 130.1, 22

[56] References Cited

U.S. PATENT DOCUMENTS

| | | | |
|---|---|---|---|
| 2,351,046 | 6/1944 | Heymann | 8/173 |
| 2,362,377 | 11/1944 | Heymann | 8/173 |
| 3,203,753 | 8/1965 | Sherburne | 8/175 |
| 3,728,078 | 4/1973 | Freshwater et al. | 8/174 |

FOREIGN PATENT DOCUMENTS

| | | | |
|---|---|---|---|
| 1080062 | 7/1960 | Fed. Rep. of Germany . | |
| 6809649 | 11/1968 | Netherlands . | |
| 609943 | 10/1948 | United Kingdom . | |
| 609948 | 10/1948 | United Kingdom . | |
| 614009 | 12/1948 | United Kingdom | 8/173 |
| 911791 | 11/1962 | United Kingdom . | |
| 1000407 | 8/1965 | United Kingdom . | |

OTHER PUBLICATIONS

Chemical Abstracts vol. 58, 9295b 1963.

*Primary Examiner*—A. Lionel Clingman
*Attorney, Agent, or Firm*—Gerald D. Sharkin; Richard E. Vila; Thomas C. Doyle

[57] ABSTRACT

Polyester or polyester blend textile material is dyed with a disperse dyestuff in the presence of a benzalketo derivative as a dyeing carrier.

27 Claims, No Drawings

DISPERSE DYEING OF POLYESTER WITH BENZALKETO DERIVATIVES AS CARRIERS: BENZALACETONE, METHYL CINNAMATE ETC.

This application is a continuation-in-part of copending application Ser. No. 786,073, filed Apr. 11, 1977, now abandoned.

IMPROVEMENTS IN OR RELATING TO ORGANIC COMPOUNDS

The present invention relates to a dyeing method effected in the presence of a benzalketo derivative as a dyeing carrier, and, more particularly, provides a method of dyeing a polyester or polyester blend textile material with a disperse dyestuff characterised in that the dyeing is effected in the presence of a dyeing carrier of formula I,

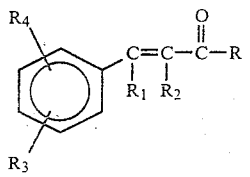

I wherein

R is $(C_{1-4})$alkyl or $(C_{1-4})$alkoxy, each of $R_1$ and $R_2$, independently, is hydrogen, halogen, methyl or ethyl, and each of $R_3$ and $R_4$, independently, is hydrogen, halogen, hydroxyl, $(C_{1-2})$alkyl or $(C_{1-2})$alkoxy, or a mixture of such dyeing carriers.

Throughout this specification the term "halogen" means chlorine or bromine, of which chlorine is the preferred halogen.

When R, $R_3$ or $R_4$ is alkyl, it is preferably methyl, and when R is alkoxy this is preferably methoxy.

Preferably both of $R_1$ and $R_2$, are hydrogen, but when only one of $R_1$ and $R_2$ is hydrogen, preferably $R_1$ is hydrogen.

Preferably either one of $R_3$ and $R_4$ is hydrogen while the other is hydrogen, halogen, hydroxyl, $(C_{1-2})$alkyl or $(C_{1-2})$alkoxy, or one is halogen while the other is halogen, hydroxyl or $(C_{1-2})$alkoxy. More preferably each of $R_3$ and $R_4$, independently, is hydrogen or halogen, most preferably both being hydrogen.

When both $R_3$ and $R_4$ are other than hydrogen, one is preferably ortho and the other preferably para to the group

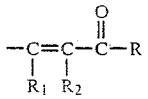

Furthermore, when only one of $R_3$ and $R_4$ is hydrogen, the substituent signified by the other is preferably ortho or para to such group.

The preferred compounds of formula I for use in the method of the present invention are benzalacetone and methyl cinnamate.

Many of the compounds of formula I are known and can be produced by known methods. Those not previously known are obtainable in conventional manner from available starting materials.

In the method of the present invention the compounds of formula I are preferably used in association with an emulsifier or mixture of emulsifiers and optionally a solvent or mixture of solvents, and are preferably added to the dyebath prior to dyeing, most preferably in a formulation containing such extra constituents. The formulations, also provided by the present invention, preferably contain 5 to 95, more preferably 20 to 80 and most preferably 30 to 60 weight percent of one or more compounds of formula I, 5 to 25 and more preferably 10 to 20 weight percent of an emulsifier or mixture of emulsifiers, and 0 to 80, more preferably 0 to 60 and most preferably 20 to 60 weight percent of a solvent or mixture of solvents.

The emulsifiers for use in such formulations may be those conventionally used in disperse dyeing from aqueous dyebaths, anionic ones being preferred. Especially preferred are mono-2-ethylhexyl sulphosuccinate, $(C_{8-18})$alkyl sulphonates, sulphonated castor oils, oxyalkylated $(C_{8-18})$ alkanols, oxyalkylated $(C_{8-18})$ fatty acids, and addition products of isooctylphenol with up to 100, preferably 6 to 30 units per molecule of ethylene oxide followed by chloroacetic acid to form a terminating group. Mixtures of emulsifiers are preferred.

The solvents or mixtures of solvents used in such formulations may be those conventionally used in disperse dyeing from aqueous dyebaths, and preferably have the properties of carriers for disperse dyestuffs as well as being solvents for the compounds of formula I. Preferred solvents are liquid polyethyleneglycols, i.e. polyethyleneglycols up to a molecular weight of 600, water-soluble alcohols, such as $(C_{1-4})$alkanols, glycols such as $(C_{2-4})$ glycols, and acetone, and preferred solvents with carrier properties are $(C_{1-4})$alkyl benzoates and mono-, di- or tri$(C_{1-2})$alkyl-substituted benzenes, e.g. especially trimethylbenzenes.

The concentration of the compound or compounds of formula I in the dyebath in the method of the invention is preferably 0.4 to 5, or more preferably 0.5 to 2 g/l.

Examples of polyester blend textile materials dyeable according to the method of the invention are those containing polyamides, e.g. wool, or cellulosic materials, e.g. cotton. Polyester-wool blend textile materials are preferably dyed with dyestuffs specially suitable for wool, e.g. C.I. Acid Blue 80 or C.I. Acid Blue 250, while polyester-cotton blend textile materials are preferably dyed with dyestuffs specially suitable for cotton, e.g. direct dyestuffs. According to the kinds of constituents present in the textile material, sufficient suitable dyestuffs can be used in the same dyebath.

The textile material is preferably dyed, in the presence of a compound of formula I, with 0.2 to 8%, more preferably 1 to 4% of its own weight of disperse dyestuff. Suitable disperse dyestuffs for polyesters include those of the anthraquinone or azo dyestuffs series, e.g. C.I. Disperse Orange 25, C.I. Disperse Blue 73, C.I. Disperse Red 73 and C.I. Disperse Blue 16.

An advantage of the method of the present invention is that the dyeing may be effected at temperatures up to 100° C., which is especially desirable when the textile material contains wool as a constituent. After the dyeing, the textile may be washed, advantageously in the presence of a detergent, and then dried.

The dyeings obtained by the method of the invention are acceptably level and possess a degree of light fastness not inferior to that obtained by high-temperature dyeing under pressure at 120° to 140° C., i.e. at temperatures higher than those normally used in the method of the present invention. The surface of the dyed substrate is not significantly adversely affected, e.g. does not tend to decompose with resultant yellowing.

Furthermore the compounds of formula I do not adversely affect the exhaust of the dyestuffs, so that the dyebath is practically fully exhausted and the dyeings obtained possess notable depth of dyeing.

A further advantage of the method of the invention resides in that the compounds of formula I utilised therein possess a relatively weak and not too irritating smell, and, especially in the case of those not featuring halogen substitution, are relatively non-toxic and easily biologically degradable. Thus their use is acceptable both from the point of view of those engaged in effecting the method and from the ecological standpoint.

In the following Examples, which illustrates the method and formulations of the present invention, the parts and percentages are by weight and the temperatures are in degrees Centigrade.

EXAMPLE 1

5 g of a fabric consisting of a mixture of 55 parts of polyethylene terephthalate fibres and 45 parts of wool are treated in an aqueous dyebath at a temperature of 95° and a goods:liquor ratio of 1:35 for 90 minutes. The dyebath contains 5%, relative to the weight of the fabric, of a mixture of 81.1 parts of a disperse dyestuff mixture consisting of 4% of the dyestuff C.I. Disperse Orange 25, 41.1% of the dyestuff C.I. Disperse Blue 73 and 54.9% of the dyestuff C.I. Disperse Blue 16 and 18.9 parts of the dyestuff mixture for wool consisting of 48.7% of the dyestuff C.I. Acid Blue 80 and 51.3% of the dyestuff C.I. Acid Blue 250, and 2 g per liter of a carrier preparation, which consists of the following constituents in a mixture:

- 60 parts of benzalacetone
- 20 parts of a commercial mixture of trimethyl benzenes (mainly 1,2,4-trimethylbenzene) as solvent serving as carrier
- 8 parts of mono-2-ethylhexyl ester of the sodium salt of sulphosuccinic acid as emulsifier
- 8 parts of sulphonated castor oil as emulsifier
- 3 parts of the addition product of isooctyl phenol with 6 ethyleneoxide units and chloroacetic acid as emulsifier
- 1 part of the addition product of isooctyl phenol and 30 units of ethyleneoxide as emulsifier A deep marine blue dyeing with good level characteristics is obtained. Both components of the fibre mixture display good level tones. The dyebath is practically fully exhausted.

When an equal amount of methyl cinnamate is used in place of benzalacetone, comparable good results are obtained.

EXAMPLE 2

5 g of a polyethylene terephthalate fabric, known commercially under the name "Dacron", are treated in a boiling aqueous dye bath at a temperature of about 98° and a goods: liquor ratio of 1:40 for 1 hour. The dyebath contains 1.25% of the disperse dyestuff C.I. Disperse Red 73 and 10% of the carrier preparation used in Example 1, relative to the weight of the fabric. The deep ruby red dyed fabric is washed with the addition of a detergent, hot rinsed, cold rinsed and dried in air.

What is claimed is:

1. A method of dyeing a polyester or polyester blend textile material with a disperse dyestuff which comprises exhaust dyeing in a dyebath to which has been added before the introduction of the textile material a dyeing carrier of formula

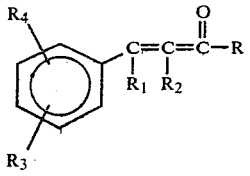

wherein

R is $(C_{1-4})$alkyl or $(C_{1-4})$alkoxy, each of $R_1$ and $R_2$, independently, is hydrogen, halogen, methyl or ethyl, and each of $R_3$ and $R_4$, independently, is hydrogen, halogen, hydroxyl, $(C_{1-2})$alkyl or $(C_{1-2})$alkoxy, or a mixture of such dyeing carriers.

2. A method according to claim 1, in which $R_1$ is hydrogen.

3. A method according to claim 2, in which $R_2$ is hydrogen.

4. A method according to claim 1, in which one of $R_3$ and $R_4$ is hydrogen.

5. A method according to claim 4, in which one of $R_3$ and $R_4$ is hydrogen, and the other is hydrogen, chlorine, hydroxyl, methyl or $(C_{1-2})$alkoxy.

6. A method according to claim 1, in which one of $R_3$ and $R_4$ is halogen, and the other is halogen, hydroxyl or $(C_{1-2})$alkoxy.

7. A method according to claim 5, in which each of $R_3$ and $R_4$ is hydrogen

8. A method according to claim 7, in which the dyeing carrier is benzalacetone.

9. A method according to claim 7, in which the dyeing carrier is methyl cinnamate.

10. A method according to claim 1, in which the concentration of the carrier or carriers in the dyebath is 0.4 to 5 g/l.

11. A method according to claim 1, in which the dyeing carrier or carriers are used in association with an emulsifier or mixture of emulsifiers.

12. A method according to claim 2, in which the carrier or carriers constitute 5 to 95 weight percent, the emulsifier or mixture of emulsifiers 5 to 25 weight percent, and a solvent or mixture of solvents 0 to 80 weight percent of the formulation

13. A method according to claim 11, in which the emulsifier or mixture of emulsifiers is selected from mono-2-ethylhexyl sulphosuccinate, sulphonated castor oils and addition products of isooctylphenol with up to 100 units per molecule of ethylene oxide followed by chloroacetic acid to form a terminating group.

14. A method according to claim 12, in which the solvent or mixture of solvents is selected from polyethylene glycols up to a molecular weight of 600, $(C_{1-4})$alkanols, $(C_{2-4})$glycols, acetone, $(C_{1-4})$alkyl benzoates and mono-, di- and tri$(C_{1-2})$alkyl-substituted benzenes.

15. A method according to claim 1, in which the amount of disperse dyestuff used is 0.2 to 8% of the weight of the polyester or polyester blend textile material.

16. A method according to claim 1, in which the polyester blend textile material contains wool or cotton.

17. A formulation comprising a dyeing carrier or mixture of dyeing carriers of formula I, as defined in claim 1 and an emulsifier or mixture of emulsifiers.

18. A formulation according to claim 17, containing, by weight of said formulation, 5 to 95 weight percent of one or more dyeing carriers, 5 to 25 weight percent of an emulsifier or mixture of emulsifiers, and 0 to 80 weight percent of a solvent or mixture of solvents.

19. A formulation according to claim 17, in which the emulsifier or mixture of emulsifiers is selected from mono-2-ethylhexyl sulphosuccinate, sulphonated castor oils and addition products of isooctylphenol with up to 100 units per molecule of ethylene oxide followed by chloroacetic acid to form a terminating group.

20. A formulation according to claim 17, in which the solvent or mixture of solvents is selected from polyethylene glycols up to a molecular weight of 600, $(C_{1-4})$alkanols, $(C_{2-4})$glycols, acetone, $(C_{1-4})$alkyl benzoates and mono-, di- and tri$(C_{1-2})$alkyl-substituted benzenes.

21. A method according to claim 1 wherein the carrier and emulsifier are in a formulation which is added to the dyebath prior to dyeing.

22. A method according to claim 21 wherein the formulation contains a solvent or mixture of solvents.

23. A formulation according to claim 17 which contains a solvent or mixture of solvents.

24. A process according to claim 1 wherein the polyester is polyethylene terephtalate.

25. A process according to claim 1 wherein the dyeing is effected at a temperature up to 100° C.

26. A process according to claim 10 wherein the dyeing is effected at a temperature up to 100° C.

27. A process according to claim 26 wherein the material being dyed is a blend of polyester and wool.

* * * * *

UNITED STATES PATENT AND TRADEMARK OFFICE

CERTIFICATE OF CORRECTION

PATENT NO. : 4,229,172

DATED : October 21, 1980

INVENTOR(S) : HANS-PETER BAUMANN et al.

It is certified that error appears in the above-identified patent and that said Letters Patent is hereby corrected as shown below:

Claim 1; the formula should read

-- 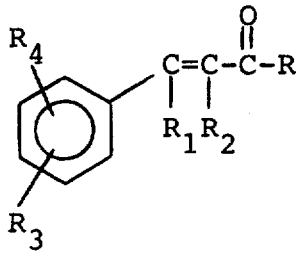 --.

Claim 21, line 1; "claim 1" should read --claim 11--.

Claim 24, line 2; "terephtalate" should read --terephthalate--.

Signed and Sealed this

*Twenty-third* Day of *August 1983*

[SEAL]

*Attest:*

GERALD J. MOSSINGHOFF

*Attesting Officer*

*Commissioner of Patents and Trademarks*